United States Patent [19]

Roltgen et al.

[11] Patent Number: 4,754,896

[45] Date of Patent: Jul. 5, 1988

[54] DISPOSABLE LEAK PROOF FILTER CONTAINER

[75] Inventors: James P. Roltgen, Eden; Larry G. Wills, West Bend; Dennis S. McGuigan, Cross Plains; Dennis J. Lathrop, Fond du Lac, all of Wis.

[73] Assignee: Brunswick Corporation, Skokie, Ill.

[21] Appl. No.: 40,880

[22] Filed: Apr. 21, 1987

[51] Int. Cl.[4] ..... B65D 43/14; B65D 51/04

[52] U.S. Cl. ..... 220/339; 206/216; 206/225

[58] Field of Search ..... 220/339, 377; 206/45.31, 216, 525

[56] References Cited

U.S. PATENT DOCUMENTS 4,202,464 5/1980 Mohs et al. ..... 220/339

4,602,719 7/1986 Borst ..... 220/339

*Primary Examiner*—George T. Hall

*Attorney, Agent, or Firm*—Andrus, Sceales, Starke & Sawall

[57] ABSTRACT

A disposable leak proof container for an oil filter includes a cylindrical receptacle having an open top and defining a filter receiving chamber for receiving and holding an oil filter therein, a cap hinged to the receptacle for covering the open top of the receptacle, and a resealable tongue and groove closure for releasably sealing the cap and receptacle in a leak proof manner. The cap, receptacle and closure are preferably formed integral with each other as a one-piece transparent plastics structure.

17 Claims, 1 Drawing Sheet

DISPOSABLE LEAK PROOF FILTER CONTAINER

BACKGROUND OF THE INVENTION

The present invention relates to oil filters, and more particularly to a disposable leak proof container for new as well as used oil filters.

Lubricating oil utilized with internal combustion engines in marine propulsion drive systems is subjected to high stress due to the relatively high operating temperatures of such engines as well as the relatively higher RPMs under which such engines operate. As a result, it is desirable for operators of such marine drive systems to change the oil and oil filter on a regular basis. Typically, a boat operator is changing the oil and filter from a location inside the boat so that it is desirable to avoid spilling oil, especially the oil which remains within the old, used oil filter after removal from the engine, on the deck of the boat. Thus, it is desirable to provide a container which not only can be utilized to package a new filter, but also may be utilized to receive the old used filter and seal the old filter therein in a leak proof manner.

Prior known packaging or containers for oil filters include cardboard or paper containers which are not leak proof and therefore of little value for disposing of used oil filters, and containers of the "blister" packaging type. However, once new filters are removed from "blister" type packaging, the containers which housed the new filter can no longer be utilized for disposing of an old filter since such containers are not leak proof.

SUMMARY OF THE INVENTION

A disposable leak proof container for an oil filter. The container may not only be utilized for packaging and housing new unused oil filters for sale to consumers, but may also be conveniently reutilized for containing and disposing of old used oil filters in a leak proof manner.

In one aspect of the invention, the container includes a fluid impermeable receptacle having an open top and defining a filter receiving chamber for receiving and holding an oil filter, a cap for covering the open top of the receptacle, and closure means for releasably sealing the cap and receptacle in a leak proof manner. The receptacle may be shaped to substantially correspond to the shape of the oil filter therein and may be dimensioned to substantially enclose the oil filter therein. Preferably, the receptacle is cylindrically shaped.

In another aspect of the invention, the receptacle, cap and resealable closure means are formed integrally with one another as a one-piece structure with the cap hinged to the receptacle. The one-piece structure may be composed of a plastics material and is preferably of a transparent nature. The resealable closure means may comprise a tongue and groove joint with the groove formed integrally in an outwardly projecting flange portion about the peripheral upper edge at the open top of the receptacle, and the tongue formed integrally in a cap flange portion formed integrally in an outwardly projecting flange portion about a peripheral edge of the cap. The cap may also include a tab member integral therewith for ease of opening the receptacle.

The present invention thus provides a container which may be initial utilized as a package for a new oil filter, and which may be reutilized to contain an old used oil filter in a leak proof manner. The container and old oil filter may then be disposed of at the user's convenience, and the leak proof seal avoids the worry of oil leaking or spilling onto a boat deck before, during or after an oil change.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
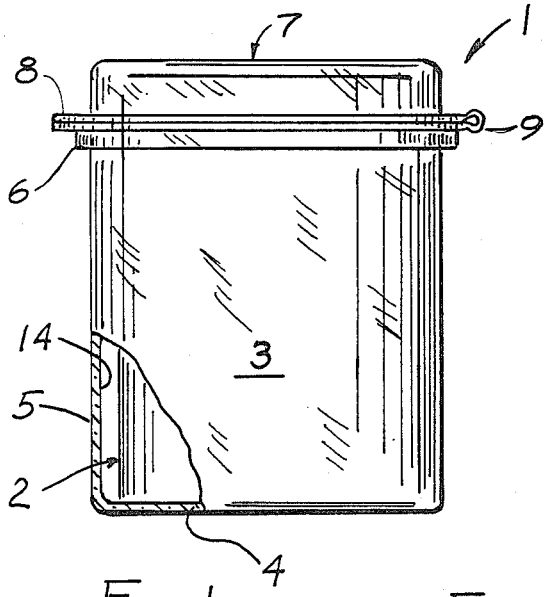
FIG. 1 is a side view in elevation of an oil filter container constructed in accordance with the principles of the present invention with an oil filter enclosed therein.
Figure 2:
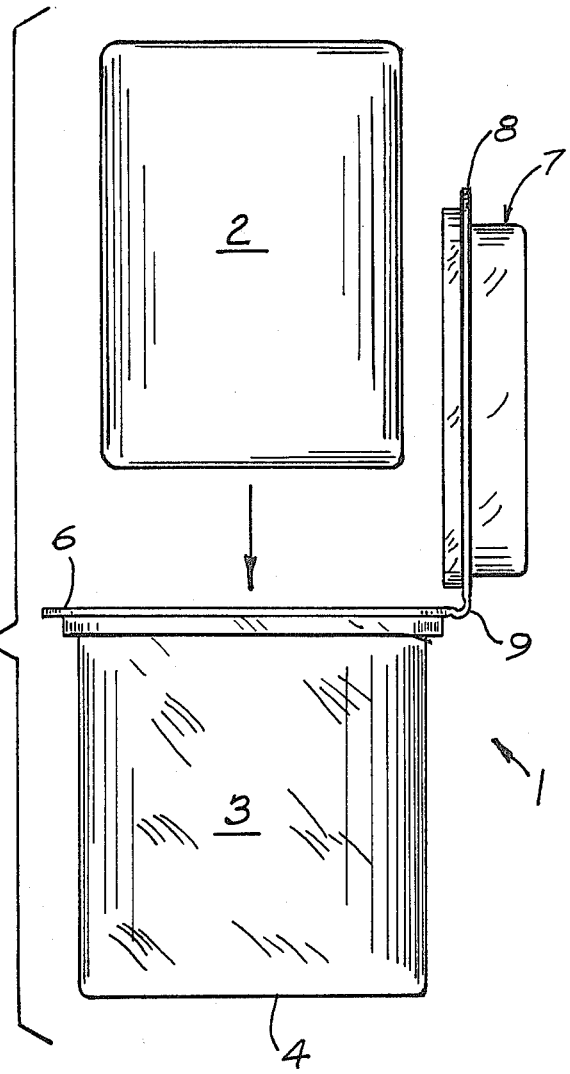
FIG. 2 is an exploded view of the container and oil filter shown in FIG. 1 with the container in its open position.
Figure 3:
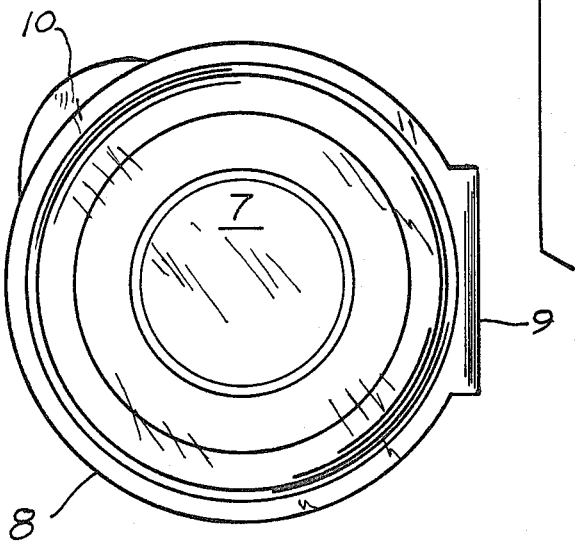
FIG. 3 is a top plan view of the container of FIG. 1.

Referring now to the drawings, FIGS. 1–3 illustrate a disposable leak proof container generally designated by the numeral 1 for receiving and holding an oil filter 2 therein. Oil filter 2 is a conventional oil filter which is typically utilized for cleaning and protecting lubricating oil utilized with internal combustion engines, such as inboard marine drives for boats, pleasure craft and the like. As a result, oil filter 2 need not further be described herein.

Container 1 is formed in one-piece, and is preferably composed of a transparent plastics material such as vinyl. However, container 1 may also be composed of other plastics material such as polyurethane, polystyrene and the like, and may also be composed of other materials such as rubber and/or paper materials so long as the material of construction is impermeable to fluids such as water and oil, and may be constructed in a leak proof manner. Economic considerations also dictate that the materials of construction be such that container 1 is disposable so that a user need not be concerned with cleaning and reutilizing container 1.

Container 1 includes a fluid impermeable receptacle 3 having a base 4, an upright substantially cylindrical side wall 5 and an open top. Receptacle 3 defines a cylindrical filter receiving chamber 6 for receiving and holding oil filter 2, and as best shown in FIG. 1 receptacle 3 is shaped to substantially correspond to the shape of oil filter 2 when received therein and dimensioned to substantially enclose oil filter 2 therein. Receptacle 3 also includes an outwardly projecting annular flange portion 6 about its periphery at its open top.

Container 1 also includes a fluid impermeable cap 7 for covering the open top of receptacle 3. Cap 7 includes an outwardly projecting flange portion 8 about its peripheral lower edge having a diameter substantially identical with the diameter of flange portion 6. Cap 7 is joined to receptacle 3 by means of a "living" hinge 9 connecting flange portions 6 and 8 along one side of receptacle 3, as best shown in FIGS. 2 and 3. Cap 7 and receptacle 3 are integrally formed with one another as a one-piece structure being connected together by hinge 9. Cap 7 further includes a tab member integral therewith and projecting from flange portion 8 for ease of opening receptacle 3, as shown best in FIG. 3.

Figure 4:
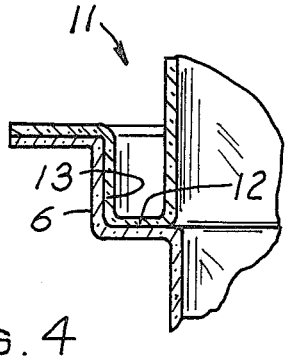
FIG. 4 is an enlarged cross sectional view of the resealable leak proof closure mechanism for the container of FIG. 1.

In order to releasably seal cap 7 and receptacle 3 in a leak proof manner, container 1 is provided with a resealable closure means comprising an annular tongue and groove joint 11. As shown best in FIG. 4, a tongue 12 is formed integrally in the cap flange portion 8 and resealably mates with a groove 13 formed integrally in the receptacle flange portion 6. Both tongue 12 and groove 13 are annular in shape, and thus when mated and forced together around the entire periphery of flange portions 6 and 8 cap 7 and receptacle 3 are provided with a leak proof seal so as to prevent any oil from leaking out of the interior of container 1, and also to prevent any water from seeping into container 1.

In operation, a boat owner or service personnel purchasing a new oil filter for a marine drive system would receive filter 2 packaged in container 1 substantially as shown in FIG. 1. The user would remove new oil filter 2 from container 1, remove the old used oil filter from the marine drive, and then place the old used filter together with any used oil remaining within the old used filter within chamber 14 of receptacle 3 such that the threaded open end of the filter extends upwardly. Finally, the user would seal cap 7 to receptacle 3 by forcing tongue 12 into groove 13. Container 1, which now contains an old used oil filter, may then be safely placed on the deck of the boat without fear of oil leakage onto the boat deck. Container 1 and the old used oil filter may then be disposed of at the user's convenience.

A disposable leak proof container for an oil filter has been illustrated and described. Various modifications and/or substitutions to the specific structure and composition described herein may be made without departing from the scope of the present invention. For example, container 1 may be rectangular or square in shape, may be made out of various types of plastics, rubber and the like materials, and various types of resealable closure means for providing a leak proof seal may be employed.

Various modes of carrying out the invention are contemplated as being within the scope of the following claims particularly pointing out and distinctly claiming the subject matter which is regarded as the invention.

We claim:

1. A disposable leak proof container for an oil filter, comprising:

a fluid impermeable receptacle having a base, an upright side wall and an open top, said receptacle defining a filter-receiving chamber for receiving and holding an oil filter, said receptacle shaped to substantially correspond to the shape of the oil filter therein and dimensioned to substantially enclose the oil filter therein;

a fluid impermeable cap hinged to said receptacle for covering the open top of said receptacle, said cap and receptacle formed integrally with one another as a one-piece structure; and resealable closure means for releasably sealing said cap and said receptacle in a leak proof manner whereby said container may be re-used to dispose of a used filter containing oil.

2. The container of claim 1 wherein said receptacle is cylindrically shaped.

3. The container of claim 1 wherein said one-piece structure is composed of a plastics material.

4. The container of claim 3 wherein said plastics material is transparent.

5. The container of claim 1 wherein said closure means comprises a tongue and groove joint.

6. The container of claim 5 wherein said tongue is formed integrally on said cap and said groove is formed integrally on said receptacle.

7. The container of claim 1 wherein said cap further includes a tab member integral therewith for ease of opening said receptacle.

8. The container of claim 6 wherein said receptacle includes an outwardly projecting flange portion about its periphery at said open top and said groove is formed in said receptacle flange portion.

9. The container of claim 8 wherein said cap includes an outwardly projecting flange portion about its peripheral edge and said tongue is formed in said cap flange portion.

10. In combination, an oil filter and a disposable leak proof container for the oil filter, said container comprising a fluid impermeable receptacle having a base, an upright side wall and an open top, said receptacle defining a filter-receiving chamber for receiving and holding an oil filter, said receptacle shaped to substantially correspond to the shape of the oil filter therein and dimensioned to substantially enclose the oil filter therein; a fluid impermeable cap hinged to said receptacle for covering the open top of said receptacle, said cap and receptacle each composed of a flexible plastics material and formed integrally with one another as a one-piece structure; and resealable closure means including a resealable joint between said receptacle and said cap for releasably sealing said cap and said receptacle in a leak proof manner whereby said oil filter is positioned closely adjacent the wall of said receptacle and rigidly supports said releasable joint to prevent excessive flexing thereof which could cause oil leakage so that said container may be re-used to dispose of a used filter containing oil.

11. The container of claim 10, wherein said receptacle is cylindrically shaped.

12. The container of claim 10 wherein said plastics material is transparent.

13. The container of claim 10 wherein said closure means comprises a tongue and groove joint.

14. The container of claim 13 wherein said tongue is formed integrally on said cap and said groove is formed integrally on said receptacle.

15. The container of claim 10 wherein said cap further includes a tab member integral therewith for ease of opening said receptacle.

16. The container of claim 14, wherein said receptacle includes an outwardly projecting flange portion about its periphery at said open top and said groove is formed in said receptacle flange portion.

17. The container of claim 16 wherein said cap includes an outwardly projecting flange portion about its peripheral edge and said tongue is formed in said cap flange portion.

* * * * *

UNITED STATES PATENT AND TRADEMARK OFFICE

CERTIFICATE OF CORRECTION

PATENT NO. : 4,754,896

DATED : July 5, 1988

INVENTOR(S) : JAMES P. ROLTGEN ET AL

It is certified that error appears in the above-identified patent and that said Letters Patent is hereby corrected as shown below:

Title page:

At [54], After "PROOF" insert ---OIL---;

Col. 1, line 1, After "PROOF" insert ---OIL---;

Col. 1, line 64, Delete "initial" and substitute therefor ---initially---;

Claim 11, col. 4, line 42, After "10" delete "," (comma);

Claim 16, col. 4, line 54, After "14" delete "," (comma).

Signed and Sealed this

Second Day of May, 1989

*Attest:*

*Attesting Officer*

DONALD J. QUIGG

*Commissioner of Patents and Trademarks*